United States Patent [19]

Bartholomew

[11] 4,390,013

[45] Jun. 28, 1983

[54] PERCUSSOR ASSEMBLY

[75] Inventor: Victor L. Bartholomew, Hemet, Calif.

[73] Assignee: Hudson Oxygen Therapy Sales Company, Temecula, Calif.

[21] Appl. No.: 220,274

[22] Filed: Dec. 29, 1980

[51] Int. Cl.[3] ..... A61H 7/00

[52] U.S. Cl. ..... 128/55; 137/624.14

[58] Field of Search ..... 128/61, 72, 55, 53, 128/50, 51, 52, 54, 64; 91/403, 410, 432; 137/624.14

[56] References Cited

U.S. PATENT DOCUMENTS

| | | | |
|---|---|---|---|
| 1,023,267 | 4/1912 | Mock | 91/403 |
| 1,780,876 | 11/1930 | Grosse | 128/64 |
| 2,398,178 | 4/1946 | Ellison | 91/403 |
| 2,615,463 | 10/1952 | Burns | 128/53 |
| 2,646,039 | 7/1953 | Agosti | 128/64 |
| 3,396,721 | 8/1968 | Mencacci | 128/64 |
| 3,648,721 | 3/1972 | Skappel | 137/624.15 |

FOREIGN PATENT DOCUMENTS

| | | | |
|---|---|---|---|
| 488311 | 9/1918 | France | 128/53 |
| 344986 | 3/1931 | United Kingdom | 128/53 |

*Primary Examiner*—Richard J. Apley
*Assistant Examiner*—David J. Brown
*Attorney, Agent, or Firm*—Seiler & Quirk

[57] ABSTRACT

A percussor assembly having a gas inlet passageway, a gas outlet passageway, a gas sealing means therebetween, and a percussion member which is moved in response to gas pressure from the gas inlet passageway overcoming the gas sealing means, which gas pressure is then vented through the gas outlet passageway, includes a valve member for closing the gas inlet passageway when the gas pressure is vented through the gas outlet passageway.

7 Claims, 3 Drawing Figures

PERCUSSOR ASSEMBLY

BACKGROUND OF THE INVENTION

In co-pending application Ser. No. 50,685, filed June 21, 1979, there is disclosed a percussor for directing energy created by successive bursts of gas to a user or patient. A gas sealing means separates gas inlet and gas outlet passageways, and gas is directed through the gas inlet passageway to a gas pressure chamber, the gas pressure building up until it overcomes the gas sealing means thereby creating a burst of gas which causes the reciprocating member to be moved. Other features of the apparatus disclosed in the aforesaid co-pending application are incorporated herein by reference.

A disadvantage of the aforesaid apparatus is in excessive gas requirements for its operation. When the gas sealing means is open, gas continues to pass from the gas inlet passageway, past the sealing means, and out through the gas outlet passageway resulting in a substantial loss of gas in excess of that required for moving the reciprocating member. Further, where the incoming gas pressure is substantially high, it can cause interruption of movement of the reciprocating member by forcing the gas sealing means to remain in the open position. It is to the elimination of such disadvantages that the present invention is directed.

SUMMARY OF THE INVENTION

The present invention includes an improved percussor assembly incorporating a valve means for interrupting the flow of gas into the gas inlet passageway as it is being vented out of the gas outlet passageway. The apparatus includes a novel shuttle valve assembly operating in a cross-passageway extending between the gas inlet and gas outlet passageways. As gas passes out of the gas outlet passageway, it forces the shuttle valve to close off the gas inlet passageway, whereby incoming gas is not used during the exhaust function of the percussor assembly. By closing off the gas inlet passageway temporarily, it also prevents the gas sealing means from remaining in the open position, thereby further improving the efficiency of the apparatus.

DETAILED DESCRIPTION OF THE INVENTION

Figure 1:
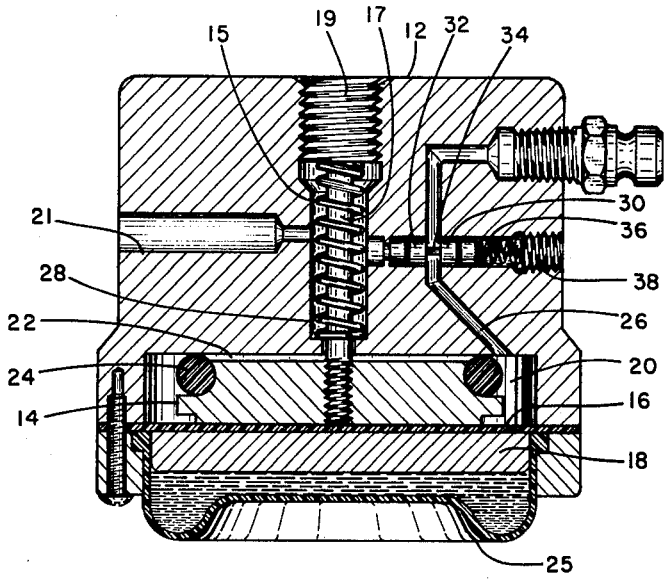
FIG. 1 is a sectional view of a percussor illustrating the improvement of the invention.

In FIG. 1 there is illustrated a percussor assembly of the invention having a housing or body 12 in which is located a gas inlet passageway 26 and gas outlet passageway 28. Between these passageways is a gas sealing means in the form of an O-ring 24.

The percussion assembly includes a plunger 18 and a reciprocating plate 14 between which is located a diaphragm 16. A membrane 25 encloses a fluid-containing chamber whereby movement of plunger 18 is translated through the fluid to membrane 25, and on to the patient or user. Shaft 17 is secured to plate 14 and spring 15 biases the shaft and the remainder of the percussion assembly, particularly plate 14, diaphragm 16 and plunger 18, upwardly, whereby O-ring 24 engages the interior percussor body surface to form a gas-tight seal between gas pressure chamber 20 and second chamber 22. Gas outlet passageway 28 communicates with second chamber 22 and is actually simply an extension of that chamber. Such an assembly is substantially like that disclosed in the aforesaid co-pending application.

Extending between gas inlet passageway 26 and gas outlet passageway 28 is a cross-passageway 50 in which is located a valve body 30. Secured between two valve body portions 32 and 35 is a constricted portion 34 of a size which allows gas to pass along gas inlet passageway 26 when the valve body is in the position shown in FIGS. 1 and 2. In other words, the cross section or overall size of constricted valve body portion 34 does not fill or occlude passageway 26 so that gas directed into the passageway is not substantially restricted by the constricted body portion. The shuttle valve assembly also includes a spring 36 which biases valve body 30 to the left as the figures are viewed whereby body portion 32 rests against stop member 52 when the valve is in the open position. The compression of spring 36 may be varied by turning threaded extension member 54 in either direction to achieve the desired bias. The valve is sealed in a gas tight manner along cross-passageway 50 by O-rings 42 and 44, although other gas sealing means may be used. The interior end 38 of the threaded extension member 54 serves both as a stop plate for valve body portion 35 and for spring 36.

Figure 3:
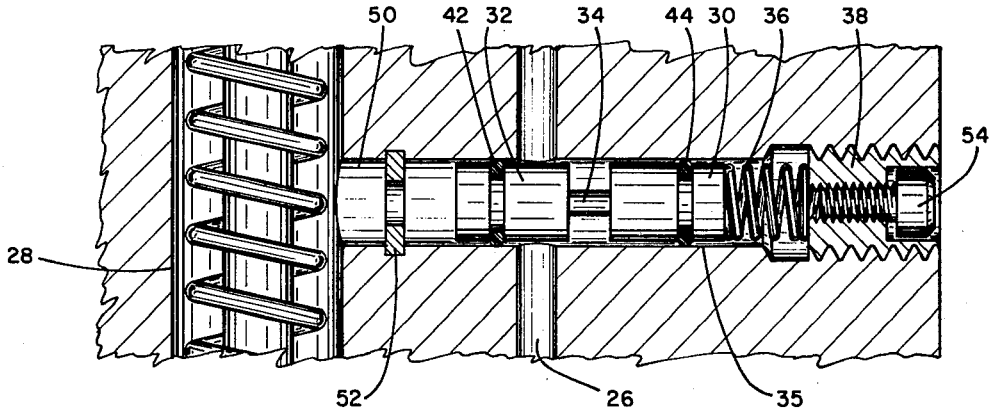
FIG. 3 is a view like that of FIG. 2 showing the valve in the closed position.

In FIG. 3, the valve is shown in a closed position with valve body 30 moved to the right whereby constricted valve body portion 32 occludes passageway 26 thereby substantially preventing gas from flowing through the passageway into gas pressure chamber 20.

Figure 2:
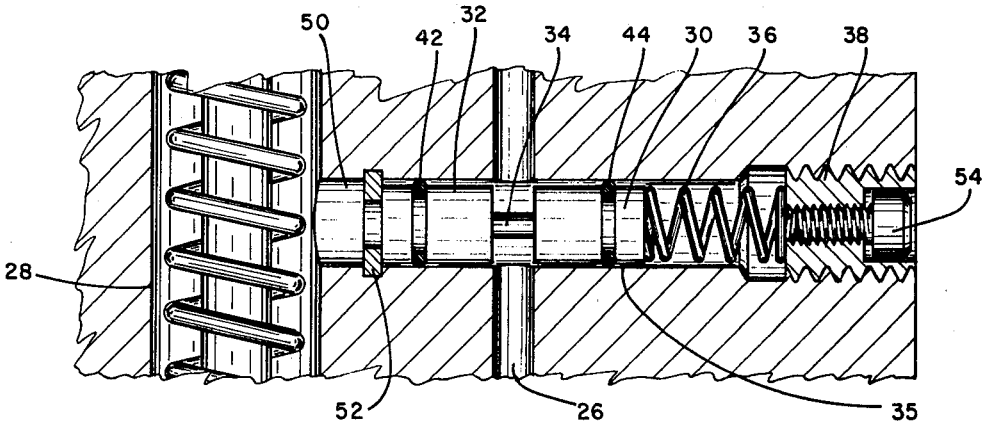
FIG. 2 is an enlarged view of a portion of FIG. 1 showing particularly the improved shuttle valve assembly in the open position.

Operation and movement of the shuttle valve assembly of the invention is achieved as the percussor operates. In the first or initial position as shown in FIGS. 1 and 2, pressurized gas introduced into passageway 26 flows into gas pressure chamber 20. Because of the bias of spring 15, the percussion assembly forces O-ring 24 against an interior surface to provide a gas-tight seal between gas pressure chamber 20 and chamber 22. Once the gas pressure in chamber 20 builds up sufficiently, it forces against diaphragm 16 until O-ring 24 is moved away from the interior surface of percussor body 12 whereby gas flows into second chamber 22 and forces the percussion assembly downwardly. Since gas outlet passageway 28 is in communication with chamber 22, the pressurized gas in that chamber is vented to atmosphere through gas outlet passageway 28 and outlet port 21. With increased gas pressure in gas outlet passageway 28, shuttle valve body 30 is forced to the right against spring 36 whereby the valve body port 32 occludes gas inlet passageway 26 and further flow of gas into gas inlet passageway 26 is temporarily stopped. Once the gas pressure in gas outlet passageway 28 has been reduced to or near atmospheric pressure, the bias of spring 36 causes the shuttle valve body 30 to be returned to its initial position shown in FIG. 2 whereby gas again can freely flow into gas inlet passageway 26. This alternating movement of the shuttle valve to temporarily open and close the gas inlet passageway continues so long as gas is supplied to the apparatus and the percussion assembly operates.

In order to preclude the possibility of gas flow into gas pressure chamber 20 forcing the gas seal to remain in the open position, the shuttle valve bias spring 36 can be selected to operate at a pressure less than that required to close the gas sealing means between chambers 20 and 22. In other words, adjustment of spring 36 is preferably such that the shuttle valve will close, i.e., be forced into the second position shown in FIG. 3, at a gas pressure less than the gas pressure required to open the gas seal and force the percussion assembly downwardly as previously explained. Thus, once percussion has been initiated, the shuttle valve will continue to operate between the open and closed position thereby assuring the continued alternative opening and closing of gas inlet passageway 26 and the desired reciprocating operation of the apparatus.

Although an O-ring 24 has been illustrated as the means for forming the gas-tight seal between chambers 20 and 22, any other suitable means of gas sealing may be used. Moreover, the specific components of the percussion assembly shown herein are for the purpose of illustration only, it being understood that any percussor incorporating a gas seal between a gas inlet passageway and gas outlet passageway, alternate opening and closing of that seal causing the percussive effect, can utilize the invention for temporarily and alternately closing the gas inlet passageway. These as well as other advantages and modifications within the purview of the invention will be understood by those skilled in the art.

I claim:

1. In a percussor assembly having a gas inlet passageway, a first gas chamber communicating therewith, a gas outlet passageway, and movable gas sealing means for providing a gas-tight seal between said first gas chamber and said gas outlet passageway, whereby increased gas pressure in said first gas chamber moves said gas sealing means and breaks said gas-tight seal resulting in said increased gas pressure in said gas pressure chamber being relieved through said gas outlet passageway, the improvement comprising valve means cooperating between said gas inlet passageway and said gas outlet passageway for closing said gas inlet passageway in response to said gas pressure being relieved through said gas outlet passageway.

2. The percussor assembly of claim 1 including a movable percussion member, and a second gas chamber communicating with said gas outlet passageway, said gas sealing means being movable between a first position providing said gas-tight seal, and a second position whereby said first gas chamber communicates with said second gas chamber whereby said percussion member is moved.

3. The percussor assembly of claim 1 wherein said valve means includes a cross-passageway communicating between said gas outlet passageway and said gas inlet passageway.

4. The percussor assembly of claim 3 wherein said valve means includes a valve body movable in said cross-passageway.

5. The percussor of claim 4 wherein said valve body is movable between a first position in which said gas inlet passageway is open, and a second position in which said gas inlet passageway is closed.

6. The percussor of claim 5 including biasing means for urging said valve body to said first position.

7. In a percussor assembly having a gas inlet passageway, a gas outlet passageway, a gas sealing means therebetween, and a percussion member, whereby gas pressure in said gas inlet passageway sufficient to overcome said gas sealing means causes movement of said percussion member and is vented through said gas outlet passageway, an improvement comprising a valve member for closing said gas inlet passageway when gas pressure is vented through said gas outlet passageway.

* * * * *